United States Patent [19]

Mortensen

[11] 3,969,047

[45] July 13, 1976

[54] ROTARY FLUID DEVICE WITH PIVOTED WEDGE-SHAPED RADIAL VANES

[76] Inventor: Peder S. Mortensen, Box 396, Sunset Drive, Hudson, Quebec, Canada

[22] Filed: Oct. 17, 1974

[21] Appl. No.: 515,461

Related U.S. Application Data

[62] Division of Ser. No. 294,517, Oct. 3, 1972, abandoned.

[52] U.S. Cl. ..... 418/18; 418/35; 418/253

[51] Int. Cl.[2] ..... F01C 1/00; F01C 21/16; F04C 17/00; F04C 29/10

[58] Field of Search ..... 418/18, 33, 35, 37, 418/253; 123/8.47; 415/70

[56] References Cited

UNITED STATES PATENTS

| | | | |
|---|---|---|---|
| 2,095,987 | 10/1937 | Kratzer | 418/37 |
| 2,243,653 | 5/1941 | Rodaway | 418/37 |
| 2,394,337 | 2/1946 | Sobek | 418/18 |
| 2,792,984 | 5/1957 | Menge | 418/18 |
| 3,337,123 | 8/1967 | Bulutay | 418/35 |

*Primary Examiner*—John J. Vrablik

[57] ABSTRACT

This invention relates to a device to displace fluids or to displace and change the volume and pressure of compressible fluids, comprising a number of vanes radiating from a hinge line or shaft and a governing rotator to change the circumferential spacing of the vanes as they revolve. In various embodiments of the invention the device may be used as a fan or pump, a jet propulsion device for aircraft, a heat pump operating on a pure gas cycle, and as a heat engine with external or internal heat source. In one embodiment of the invention the device may be used to perform the function of the wing of an aircraft, but requiring no horizontal motion of the aircraft itself; however, if this same aircraft is made to move horizontally in a certain direction very high lift coefficients may be obtained.

2 Claims, 19 Drawing Figures

ROTARY FLUID DEVICE WITH PIVOTED WEDGE-SHAPED RADIAL VANES

This is a division of application Ser. No. 294,517, filed Oct. 3, 1972, now abandoned.

Existing devices to displace fluids or to change the volume and pressure of compressible fluids fall into two categories. In devices of one category the fluid is enclosed in a space the volume of which can be changed; the cylinder and piston type device and various rotary pump devices belong in this category.

In devices of the second category a fluid, moving with respect to the device, is made to follow a curved path, and pressure changes takes place according to the well known Bernoulli Equation; devices in this category are the centrifugal pump or fan, the axial fan, pump or turbine and the airfoil on aircraft.

A disadvantage of the cylinder and piston type device is that it has relatively heavy reciprocating parts, and also, when used as a heat pump or heat engine with external heat source, its geometry is very disadvantageous for heat transfer. Most of the various existing positive displacement rotary devices are not suitable for embodiments of large sizes. A basic disadvantage of devices in the second category is that in order to produce an often required pressure effect, using ordinary fluids such as air or steam, the working elements of the device must have a high speed with respect to the fluid; this leads to very high rotary speeds if the size is limited and to large dimensions if the speed of rotation is limited.

This same basic disadvantage also cause high take off and landing speeds for fixed wing aircraft with large carrying capacity by a wing of limited area.

My invention overcomes these and other disadvantages, and while operating on the fluid in a direct manner like the cylinder and piston type device it can handle volumes as large as the devices of the second cited category. It is therefore in a sense a hybrid between the two categories. The device to which this invention relates comprise a number of vanes extending radially from a hinge line or shaft so that their circumferential spacing can be varied. This variation is governed by an external rotator located at one or both ends of the vane assembly.

Compared to certain rotary devices of the prior art, having blade like vanes radiating from a shaft thru slots in an excentrically located cylindrical rotor extending the full length of the vanes, my invention has several advantages and characteristics making it more adaptable for certain applications.

First, the vanes can be made wedge shaped (sectors of a circle) to achieve any required compression ratio and also to give the vanes sufficient torsional stiffness to be made relatively long and of light weight.

Second, pivoted connecting rods can be used instead of sliding joints between the vanes and the governing rotator. Third, shorter and simpler joints and seals are needed which in addition to being an obvious advantage leads to lower friction.

Fourth, more than two cycles per revolution is possible. Fifth, an enclosure around the vane assembly is not required for some embodiments of my invention.

Sixth, it is practical to make the embodiments of my invention in large sizes.

The primary object of this invention is to provide a practical and inexpensive heat pump, operating on a pure gas cycle, as proposed by Lord Kelvin in his paper of 1852 entitled, "On the Economy of the Heating or Cooling of Buildings by means of Currents of Air".

Widespread use of such a device, operated by electric power or wind power, would reduce the amount of fuel burned for heating purposes, and therefore also reduce the amount of pollutants exhausted into the atmosphere from this source.

My invention has many other uses and advantages, as will become apparent from the following description used to illustrate some preferred embodiments of the invention as read in connection with the accompanying drawings in which.

Figure 1:
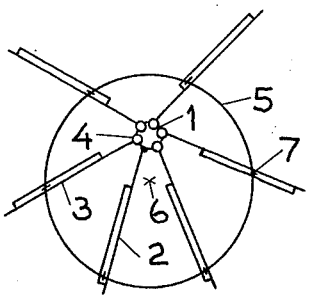
FIG. 1 is a diagramatic cross section thru an embodiment having pins to guide the vanes.

Refering now to the drawings wherein the showings are for the purpose of illustrating a number of preferred embodiments of the invention only and not for the purpose of limiting same; in FIG. 1, a vane 2 is rigidly attached to the shaft 1 and the vanes 3 are attached to the shaft by means of hinges 4. A vane governing rotator 5, able to revolve about its center 6, is engaging a slot in each vane by means of a pin 7.

Figure 2:
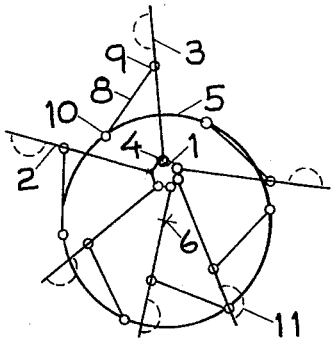
FIG. 2 is a diagrammatic cross section thru an embodiment having connecting rods to guide the vanes.

In the embodiment shown in FIG. 2, the connection between the vane assembly and the vane governing rotator is achieved by means of connecting rods 8 attached by pivots 9 to the vanes, and by pivots 10 to the vane governing rotator. In this embodiment the vanes have a cup like depression to provide room for the pivot 10 and the connecting rod.

In both embodiments, if for example, the vane governing rotator is made to revolve, then the vane assembly will also revolve and the vanes will always be closer together on one side of the device than on the diametrically opposite side of it. If the device is then immersed in a fluid, this fluid will be forced out or compressed on the side where the vane spacing is decreasing and sucked in or expanded on the side where the vane spacing is increasing.

Figure 3:
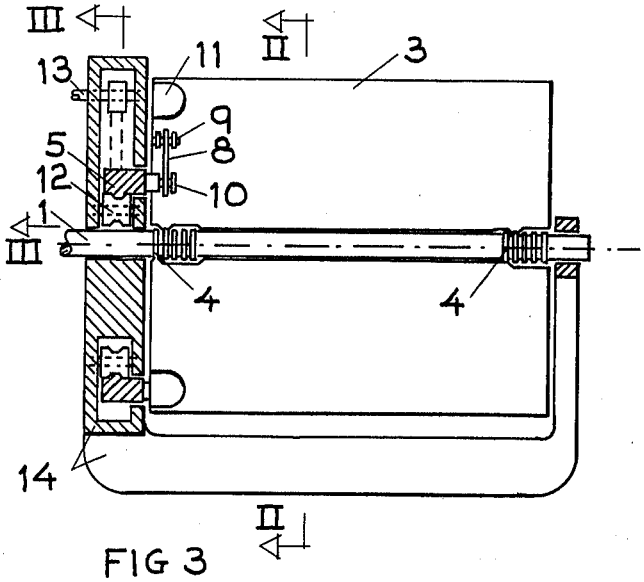
FIG. 3 is a longitudinal section thru an embodiment having connecting rods to guide the vanes.
Figure 4:
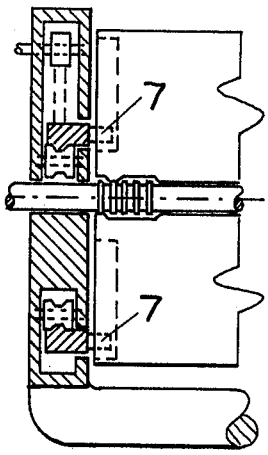
FIG. 4 is a partial longitudinal section thru an embodiment having pins to guide the vanes.
Figure 5:
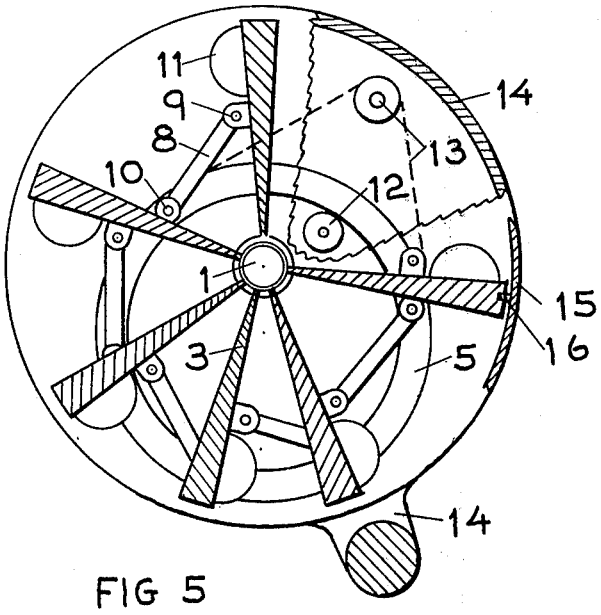
FIG. 5 is a section of the line II—II of FIG. 3, with a cut out of the line III—III of FIG. 3.

While FIG. 1 and FIG. 2 are illustrating the operating principle of the invention in a diagrammatic form, FIG. 3 and FIG. 4 shows longitudinal sections and FIG. 5 a cross section, thru practical embodiments of my invention.

As shown in FIG. 3, the shaft 1 is supported in bearings by a frame structure 14. The vane governing rotator comprise a circular ring 5, supported by rollers 12, which in turn are supported in bearings by the frame structure 14.

A drive shaft 13 is shown, but it may take many other forms or be absent to suit particular applications. The hinges 4, shown in FIG. 3, allows the vanes 3 to pivot about the exact center of the shaft 1, but in many applications, hinges with pivots at the surface of the shaft, as indicated in FIG. 1 and FIG. 2, would be acceptable.

The embodiment in which pins 7 are used to guide the movement of the vanes is shown in FIG. 4.

An enclosure 15, as indicated in FIG. 5, is required on some embodiments of the invention and in this case a seal 16 may be necessary.

Figure 6:
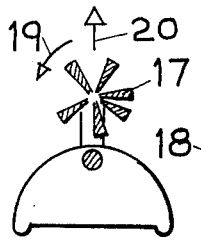
FIG. 6 is a cross section thru an aircraft for which lift is provided by an embodiment of this invention.
Figure 7:
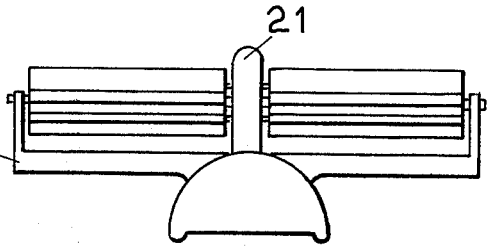
FIG. 7 is an elevation of the aircraft.

Shown in FIG. 6, is an aircraft with a body-structure 18, supporting a vane assembly 17, which is revolving in the direction indicated by the arrow 19, and thus generating a lift force as indicated by the vector 20. While FIG. 6 is a cross section thru the vane assembly of the aircraft, FIG. 7 is a longitudinal elevation with 21 signifying a housing containing the vane governing rotator.

Figure 8:
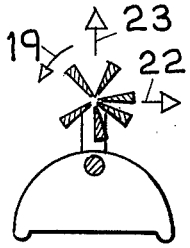
FIG. 8 is a cross section thru the aircraft when it has a horizontal motion.

FIG. 8 is similar to FIG. 6, except that the aircraft is given a horizontal motion in the direction indicated by the arrow 22, and the lift thus generated and indicated by the vector 23 is greater than the lift generated and indicated by the vector 20 in FIG. 6, the speed of rotation, as indicated by the arrow 19, being the same as in FIG. 6.

Figure 9:
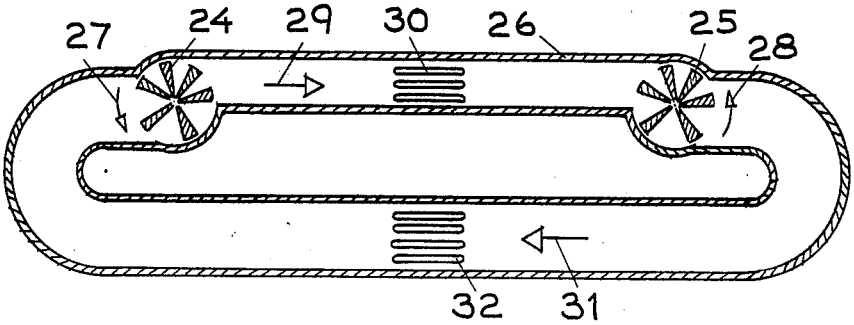
FIG. 9 is a section illustrating a heat pump system using embodiments of this invention.

In FIG. 9, a vane assembly 24, revolving as indicated by the arrow 27, is compressing and moving a compressible fluid, for example air, contained in a duct 26. The compressed and thus heated air is moving as indicated by the arrow 29 and is forced thru a heat exchanger 30 where heat is removed, and the air thereafter moves to and is expanded by the vane assembly 25, revolving as indicated by the arrow 28. The expanded and thus further cooled air is then moving as indicated by the arrow 31, and is forced thru another heat exchanger 32 where heat is added, and from there the relatively heated low pressure air is moving to the vane assembly 24, and the cycle is repeated.

As can be seen, heat is thus transferred from a low temperature reservoir, represented by the heat exchanger 32, to a higher temperature reservoir, represented by the heat exchanger 30. It is also apparent that if either the cold reservoir or the warm reservoir is the atmosphere, then the part of the duct with one of the heat exchangers can be omitted. For example, if a house were to be cooled, then the house itself would become the cold part of the duct. Similarly, if a house were to be heated, then the atmosphere outside of the house would become the cold part of the duct. In other words, the low pressure sides of the two vane assemblies 24 and 25 would simply be open to the atmosphere; inside the house in the former case and outside the house in the latter case.

Figure 10:
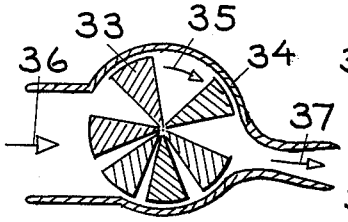
FIG. 10 is a cross section thru an embodiment used as a jet propulsion device.

In the embodiment of the invention shown in FIG. 10, a vane assembly 33, revolving as indicated by the arrow 35, in an enclosure shaped as illustrated. Air is inhaled, as indicated by the arrow 36, and after being compressed the air is expelled as a jet at high velocity, as indicated by the arrow 37. A reaction force is thus produced, which may be used to propel, for example, an aircraft.

Figure 11:
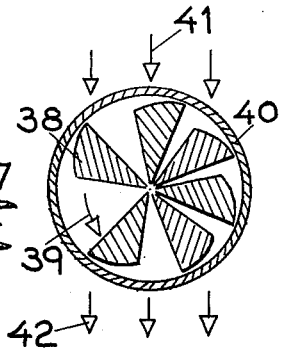
FIG. 11 is a cross section thru an embodiment used as a heat engine or heat pump.

In the embodiment of the invention shown in FIG. 11, a vane assembly 38 is revolving as indicated by the arrow 39, in an enclosure 40, completely surrounding the vane assembly. Heat energy at a high temperature, as illustrated by the arrows 41, is supplied to the expanding fluid contained in the compartments between the vanes. On the opposite side, where the fluid contained between the vanes is being compressed, heat is removed at a lower temperature and rejected as indicated by the arrows 42. A heat engine is thus constructed, and usefull mechanical energy may be gained, subject to the well known thermodynamic limitations.

If the enclosure is made transparent to radiation where the energy is received, then this energy can be in the form of, for example, solar radiation.

If the vane assembly is made to revolve by the application of power, then heat will flow in the same direction as indicated by the arrows 41 and 42, but in this case from a low temperature reservoir to a higher temperature reservoir; the device thus functioning as a complete heat pump.

Figure 12:
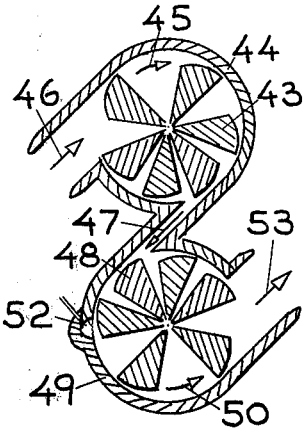
FIG. 12 is a cross section thru an embodiment used as an internal combustion engine.

In the embodiment of the invention shown in FIG. 12, two vane assemblies are employed, one serving a function analogous to the compressor on a gas turbine, and the other is serving a function analogous to that of the gas turbine itself. As shown, a vane assembly 43 is revolving as indicated by the arrow 45, in an enclosure 44. Air is inhaled, as indicated by the arrow 46, and the air is forced out at a higher pressure, as indicated by the arrow 47. The thus compressed air is entering the region of another vane assembly 48, where the expansion is just beginning. Said vane assembly 48 revolving as indicated by the arrow 50, in an enclosure 49. Fuel is continuously injected from a nozzle 52, and is burned in the expanding compartments between the vanes, whereafter the waste products from the combustion are exhausted, as indicated by the arrow 53.

Figure 13:
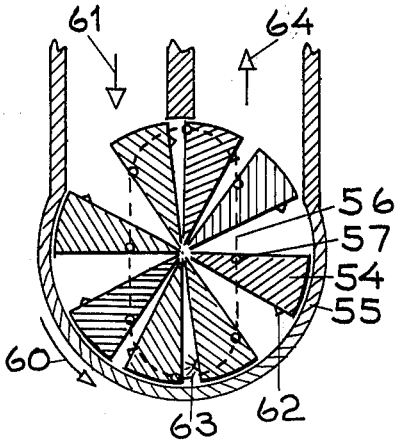
FIG. 13 is a cross section thru an embodiment used as an internal combustion engine, in which there are four cycles per revolution.
Figure 14:
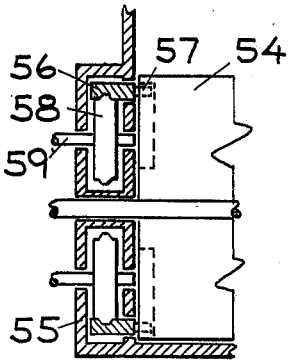
FIG. 14 is a partial longitudinal section illustrating the vane governing rotator for the embodiment shown in FIG. 13.

In the embodiment of the invention shown in FIG. 13 and FIG. 14, an internal combustion engine is constructed, using only one vane assembly.

As shown, a vane assembly 54 is revolving as indicated by the arrow 60, in an enclosure 55. The vanes are guided by a vane governing rotator 56, comprising a chain like element, supported by two sprockets 58, and engaging a slot in each vane by means of the pins 57. This engagement can also be achieved by means of connecting rods, as in the embodiments shown in FIG. 2 and FIG. 5. The vanes are thus made to move so as to produce two compression regions and two expansion regions for each revolution of the vane assembly. A fuel-air mixture is inhaled, as indicated by the arrow 61, and the mixture is compressed as the compartments containing it are decreasing in volume. In the vicinity of maximum compression, a spark plug 62 is igniting the compressed fuel-air mixture, and in the following expansion region combustion takes place and work is done, whereafter the waste products from the combustion are exhausted, as indicated by the arrow 64.

It is apparent that both embodiments of the invention, shown in FIG. 12 and in FIGS. 13 and 14, could be modified to have the fuel ignited by compression alone, as in the well known Diesel engine.

Figure 15:
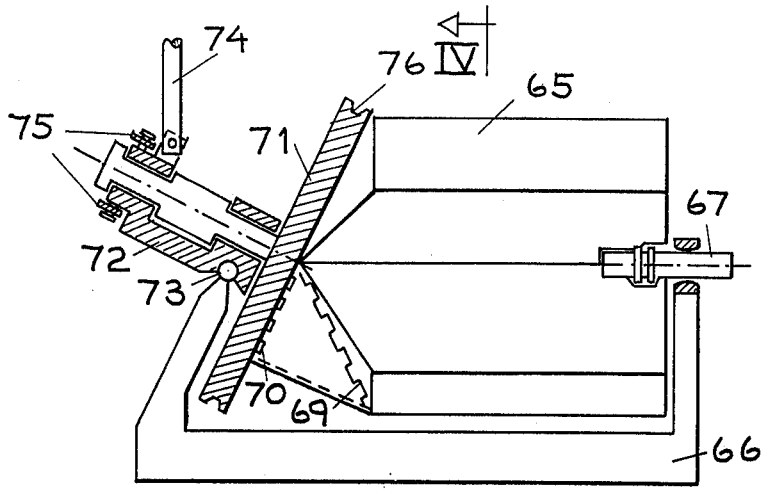
FIG. 15 is a longitudinal section thru an alternative embodiment in which the vanes are governed by a wheel rotating about an axis making an angle with the hinge line of the vanes.
Figure 16:
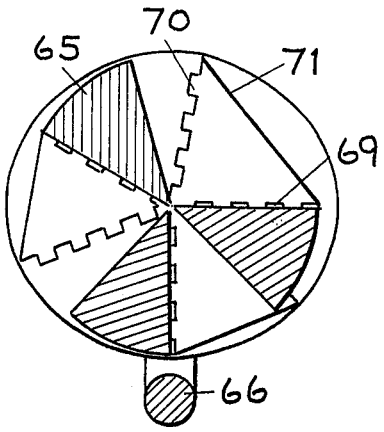
FIG. 16 is a cross section of the line IV—IV of FIG. 15.

In the embodiment of the invention illustrated in FIGS. 15 and 16, a vane assembly 65 is governed by a wheel 71 the axis of which makes an angle with the vane hinge line. Connecting panels 68, of triangular configuration, are attached to each vane by means of hinges 69 and also attached to the wheel by means of hinges 70. The end face of each vane have a slope to match the inclination of the wheel.

The vanes are thus caused to have a greater circumferential spacing on one side of the vane assembly than on the diametrically opposite side.

The bearings 72, supporting the wheel, may be mounted in a fixed position on the frame 66 or mounted, as shown in FIG. 15, so as to pivot about a ball joint 73 and controlled by means of control rods 74 and 75. This feature provides a simple means of control in two directions which is particularly useful when the vane assembly is used to provide lift for an aircraft.

Figure 17:
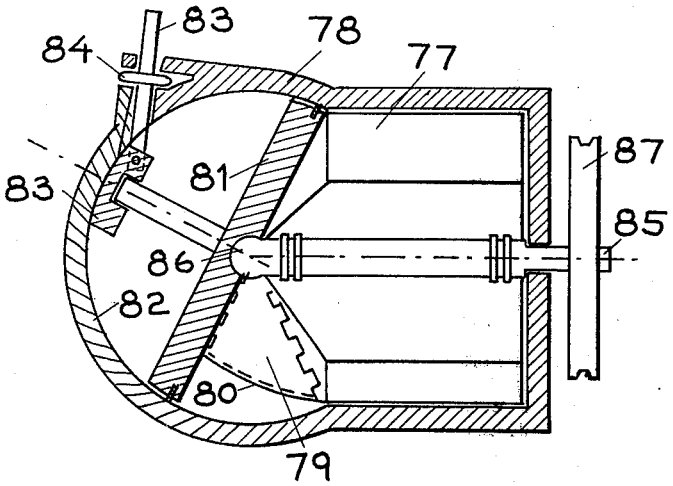
FIG. 17 is a longitudinal section thru an embodiment similar to that shown in FIG. 15, but having a surrounding enclosure.

In the embodiment shown in FIG. 17, an enclosure 78 is provided around the vane assembly and the vane governing wheel, the enclosure having an internal spherical surface 82 matching the diameter of the wheel 81. The center of the wheel and the shaft 85 are joined by means of a ball joint 86, the center of which is coinciding with the intersection between the axis of the shaft and the axis of the wheel. The edge 80, of the connecting panel 79 is made to match the spherical surface. The wheel bearing 83 may be mounted in a fixed position or have adjusting means 84 as shown. With the drive 87 mounted on the shaft, as shown, one of the vanes must be rigidly attached to the shaft.

Figure 18:
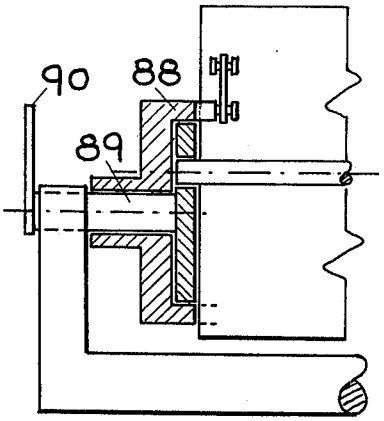
FIG. 18 is a variation of the embodiment of FIG. 3 and showing an adjustable shaft.

FIG. 18 shows a variation of the embodiment illustrated in FIG. 3, in which the vane governing rotator 88 is journalled on a short shaft 89, cantilevered from the frame, this shaft also supporting the bearing for the vane assembly. The shaft may be rigidly attached to the frame or adjustable, as shown, by means of the lever 90.

Figure 19:
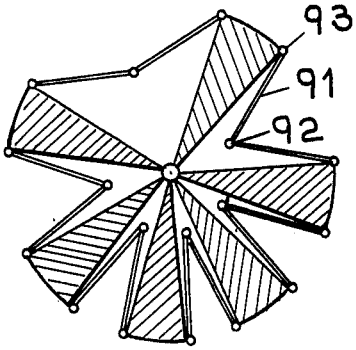
FIG. 19 shows the spaces between the vanes enclosed by hinged folding panels.

FIG. 19 shows how the space between the vanes of a vane assembly may be enclosed by means of folding panels 91, hinged to the vanes by hinges 93 and folding by means of hinges 92.

The invention has been described in sufficient detail to enable one skilled in the pertaining art to dublicate the invention. Obviously, modifications and alterations of the preferred embodiments described will occur to others upon reading and understanding this specification and it is my invention to include all such modifications and alterations as part of my invention insofar as they come within the scope of the appended claims.

I claim:

1. A device to displace fluids and to change the volume and pressure of compressible fluids comprising a number of vanes extending radially outwards from a hinge line and pivoted so that their circumferential spacing can be varied;

the vanes having a wedge shaped cross section substantially in the configuration of a sector of a circle;

a structure supporting said vane assembly so that it can revolve about an axis coinciding with the hinge line;

same structure also supporting a vane governing rotator at least at one end of the vane assembly, governing the variation of the circumferential spacing of the vanes as the vane assembly revolves;

said vane governing rotator comprising a wheel which can revolve about an axis intersecting the hinge line at an angle;

the end of each vane having a pivotally attached connecting panel the other end of which is pivotally attached to the wheel along a radial line.

2. A device as defined in claim 1, in which means are provided so that the wheel with its bearings can be pivoted about a point at or close to where the wheel axis intersects the hinge line so that the angle can be varied.

* * * * *